US006019622A

United States Patent [19]

Takahashi et al.

[11] Patent Number: 6,019,622

[45] Date of Patent: Feb. 1, 2000

[54] TERMINATION COAXIAL CONNECTOR

[75] Inventors: Michiharu Takahashi, Yachiyo; Kiyozumi Chino, Musashino; Asao Ishikawa, Abiko; Makoto Kodaira, Setagaya-ku, all of Japan

[73] Assignee: Uro Denshi Kogyo Kabushiki Kaisha, Tokyo-to, Japan

[21] Appl. No.: 09/033,396

[22] Filed: Mar. 3, 1998

[30] Foreign Application Priority Data

Mar. 3, 1997 [JP] Japan ..... 9-048187

[51] Int. Cl.[7] ..... H01R 29/00

[52] U.S. Cl. ..... 439/188; 200/51.1

[58] Field of Search ..... 439/188, 944; 200/51.1

[56] References Cited

U.S. PATENT DOCUMENTS

| | | | |
|---|---|---|---|
| 3,784,950 | 1/1974 | Coffman | 338/220 |
| 5,076,797 | 12/1991 | Moulton | 439/188 |
| 5,340,325 | 8/1994 | Pai | 439/188 |
| 5,580,261 | 12/1996 | Meynier | 439/188 |
| 5,598,132 | 1/1997 | Stabile | 333/32 R |
| 5,639,252 | 6/1997 | Despouys | 439/188 |
| 5,730,612 | 3/1998 | Tatsuzuki | 439/188 |
| 5,775,927 | 7/1998 | Wider | 439/188 |
| 5,803,757 | 9/1998 | Wang | 439/188 |
| 5,839,910 | 11/1998 | Meller et al. | 439/188 |

*Primary Examiner*—Steven L. Stephan
*Assistant Examiner*—Chandrika Prasad
*Attorney, Agent, or Firm*—Ladas & Parry

[57] ABSTRACT

Provided is a termination coaxial connector, having a wide frequency band, which is capable of handling digital signals. A coaxial F-type receptacle connector connects to a coaxial F-type plug connector. The receptacle connector principally comprises an outer conductor 1, a insulating sliding tube 2 which is accommodated inside the outer conductor so as to slide therein, a securing member 6 for securing the insulating sliding tube to the outer conductor, and a center conductor 5 which is supported in the center of the securing member 6 The insulating sliding tube further comprises a coiled spring 4 and a termination element 3, the insulating sliding tube being ordinarily forced outwards by the expansive force of the coiled spring, but being pushed between the center conductor and the termination element when a plug connector is inserted, whereby the electrical connection is broken, the termination is cancelled and both connectors are connected. When the plug connector is removed, the insulating sliding tube is once again forced out, causing the center conductor to contact the termination element and reinstate the termination.

9 Claims, 12 Drawing Sheets

TERMINATION COAXIAL CONNECTOR

BACKGROUND OF THE INVENTION

1. Field of the Invention

The present invention relates to a termination coaxial connector comprising resistance elements and the like connected between an outer conductor and a center conductor of a coaxial line connector, and more particularly to a receptacle connector which is used as a subscriber terminal connector in a signal splitter or a signal brancher in joint viewing facilities such as CATV and TV and the like.

2. Description of the Related Arts

In joint TV viewing facilities and CATV systems, splitters and branchers having wide frequency bands are used for supplying wide-band high-frequency signals, such as multichannel TV signals within the band 5–1,000 MHz, to subscriber houses along coaxial cables from a point on the system known as a headend. As signals are split, the signal level suffers gradual attenuation as a result of split loss and cable loss. Conventionally, in order to compensate for this attenuation, wide-band amplifiers are provided in appropriate positions for amplifying the signals to a predetermined level. The signals are subsequently retransmitted and resplit. In addition to the signals, power for the amplifiers is often supplied on the cables in a multiplexed format.

In such systems, since the branchers and splitters are provided in multilevel cascade connections, poor adjustment of the input terminals is liable to cause accumulated deterioration in the characteristics of the branchers and splitters due to the electrical length of the connection cables. As a result, the overall characteristics of the system may deteriorate severely at certain frequencies. Such deterioration in input impedance leads to phase distortion and amplitude distortion, damaging signal quality.

FIG. 9 shows a model configuration of a conventional CATV system, and FIG. 10 shows an example configuration of an electrically-powered branching/splitting circuit used in such a system. As FIG. 10 shows, high-frequency signals and electrical power are input at input terminal IN, but the electrical power, which has low frequency, is blocked by capacitors C1 and C2. Consequently, power does not flow to the branching/splitting circuit, but is instead fed along a choke coil L to an output terminal OUT. By contrast, the high-frequency signals, which are within a frequency range to which the choke coil L presents a sufficiently high impedance, are blocked by the choke coil L. The high-frequency signals therefore pass through capacitor C to the branching circuit (directional coupler), then through the other capacitor C2, and are finally output at the output terminal OUT.

However, some of the signals emerge at branch terminal B of the directional coupler. These signals may be split across 2–8 terminals (not shown in the diagram) of the splitter and their split outputs sent to subscriber houses, or the output of branch terminal B may be used directly as a trunk branch.

FIG. 11 shows an example of return loss characteristics at the input terminal of a branching/splitting circuit, in which the output ratio of input/branch terminal B is −5.0 dB, subsequently falling to −11. dB as result of a four-way split. The input impedance of this branching/splitting circuit is 75Ω at each terminal. Using as a reference the return loss (#1) at the input terminal when termination has been carried out for all the output and branch terminals with resistance of 75Ω, FIG. 11 shows the characteristics when each terminal is in the open state successively, disconnecting the termination resistance of the split output terminals from terminal 1 (#2) to terminal 4 (#5). As FIG. 11 shows, when the brancher/splitter subscriber terminals include a terminal to which no lead-in wire is connected (namely, a vacant terminal) such as is shown in FIG. 10, reflected waves are returned to the input terminal of the branching/splitting circuit.

The amount of reflection differs between branchers with few branches and branchers with a comparatively large number of branches, reflection being greater when the number of branches is large. In general, CATV systems include a considerable number of vacant terminals, which are provided beforehand in anticipation of an increase in the number of subscribers after the system becomes operational. As the number of subscribers increases, the number of vacant terminals is reduced. In addition, a vacant terminal is created when a subscriber cancels his subscription.

Conventionally, reflection to the input terminal caused by such vacant terminals is prevented by connecting a terminator with a resistance element, as shown in FIG. 12, to a connector, as shown in FIG. 13.

Nevertheless, there are cases when a system includes terminals which, for some reason, are not used, yet are left open. The existence of such vacant terminals causes reflected waves, as described above, resulting in amplitude distortion and phase distortion, and damaging the quality of the signals. This can cause problems such as TV ghost images, bit errors in digital signal data services, and so on.

The receptacle connector depicted in FIG. 13 is ordinarily termed an F-type connector. F-type connectors are widely used in apparatuses for CATV systems, due to their relatively simple structure and cheap cost. An F-type connector is constructed in one piece comprising an enclosure and an outer conductor of the receptacle connector. In addition, another receptacle connector, constructed separately from the enclosure, is attached by means of crimping or screwing.

For the reasons given above, there is a need for a device, for use in CATV systems and the like, which is capable of terminating with no input reflection, without having to separately connect terminators to the vacant terminals, and which does not automatically terminate when a lead-in wire is connected. Furthermore, since the characteristics of the apparatuses are liable to be damaged at high frequency when the center conductor of the connector is connected in series with the termination resistance elements, a device which is capable of carrying out termination with only the tip portion of the center conductor of the connector is desirable in order to avoid the entry of such stray reactance into the series.

Furthermore, when the termination device has been connected, it is necessary to prevent deterioration in the overall circuit due to deterioration of the characteristics of the branching/splitting circuit upon connection of the lead-in wire. The stray reactance of the device must therefore be reduced as far as possible.

SUMMARY OF THE INVENTION

The present invention has been realized after consideration of the above points and aims to provide a termination coaxial connector, capable of handling digital signals across a wide frequency band, with minimum stray reactance and least signal deterioration.

In order to achieve the above objectives, the present invention comprises a termination coaxial connector, being coaxial F-type receptacle connector for connecting to a coaxial F-type connector, comprising:

an outer conductor, having an opening provided at one end thereof and a through-hole provided at the middle of another end thereof, said outer conductor having a screw-threaded outer perimeter and a vacant cylindrical inner portion;

an insulating sliding tube, said insulating sliding tube comprising insulating material and comprising a coaxial double-insulation cylinder comprising an outer cylindrical portion and an inner cylindrical portion, said inner cylindrical portion being shorter along the axial direction than said outer cylindrical portion, said inner and outer cylindrical portions being joined at one end and a ring-shaped space being provided therebetween, said insulating sliding tube having a plug guide-in portion, provided at the middle of said end, and an end portion at an end of said inner cylindrical portion which is opposite to said joined end, said end portion being housed within said space of said outer conductor so as to slide along said outer cylindrical portion, said end portion being wedge-shaped in cross-section and becoming thinner towards the tip of said end portion;

a securing member for supporting said insulating sliding tube so that said insulating sliding tube is able to slide within a predetermined range, and also for holding a termination element, said securing member being joined to the bottom wall of said outer conductor;

an inner conductor for contacting a center conductor of a plug connector, said inner conductor being supported within said insulating sliding tube; and said termination element being, provided so as to be pressed toward a bottom wall of said outer conductor by the expansive force of a coil spring, said coil spring being housed in said ring-shaped space in said insulating sliding tube, said termination element being ordinarily connected between said outer conductor and said inner conductor;

wherein, when said insulating sliding tube is pushed toward the bottom wall of said outer conductor as a result of the insertion of a plug connector, said end portion of inner cylindrical portion, being wedge-shaped in cross-section, is forced between said inner conductor and said termination element, thereby separating them.

In other words, the termination element is first electrically connected between the inner surface of the outer conductor of the coaxial line connector and the center conductor. Then, the termination element is secured via a spring inside an insulating sliding tube comprising sleeve-shaped insulating material, the insulating sliding tube sliding forward and backward while touching the inner surface of the outer conductor, the center conductor of the coaxial line connector further comprising a pair of metallic tongue-shaped pieces, which are bent at angles to provide a spring force, this spring force being used to push the insulating sliding tube inside the outer conductor, while simultaneously holding one end of the resistance element in contact with the angular bends, thereby maintaining the termination state; alternatively, when the plug connector has been inserted, the insulating sliding tube slides toward the end of the outer conductor and consequently electrically disconnects the connection between the termination element and the metal tongue of the center conductor. The interjection of the insulating sliding tube also enables the core wire of the cable, which comprises the center conductor of the plug connector which is inserted into the center conductor, to be firmly held in place.

Furthermore, the coaxial line receptacle connector comprises a sleeve-shaped insulating sliding tube, the insulating sliding tube further comprising a plug guide-in portion, the plug guide-in portion being in the first place projected to the outside of the outer conductor by means of a spring, and a resistance element being connected between the outer conductor and center conductor of the connector. A portion of the center conductor of the coaxial line connector comprises a pair of metallic tongue-shaped pieces, which are bent at angles to provide a spring force, and the termination element is secured within the outer conductor by means of the spring force, while one end of the termination element contacts with the angular bends of the center conductor, and in addition, the termination element is secured via a spring inside an insulating sliding tube which slides forward and backward while touching the inner surface of the outer conductor, thereby connecting the center conductor to the resistance element; and when the plug connector has been inserted, the plug guide-in portion of the insulating sliding tube is pushed toward the inside of the connector, whereby a portion of the insulating sliding tube becomes interjected between the termination element and the metal tongue of the center conductor, breaking the electrical connection between the outer conductor and the center conductor.

For a more complete understanding of the present invention and the advantages thereof, reference is now made to the following description taken in conjunction with the accompanying drawings.

DESCRIPTION OF THE PREFERRED EMBODIMENTS

Next, the preferred embodiments of the present invention will be explained in detail, taking as an example an F-type receptacle connector.

Embodiment 1

Figure 1:
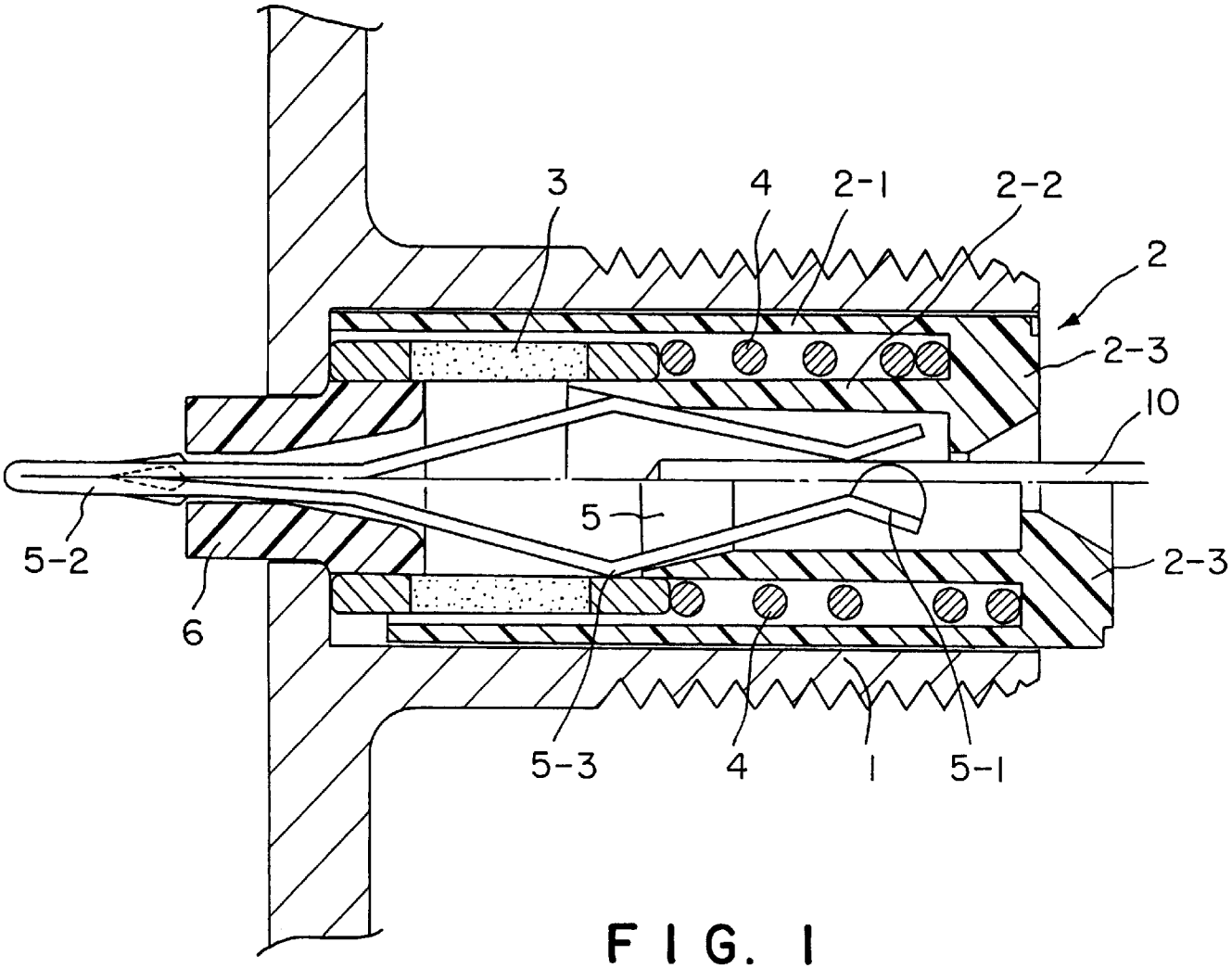
FIG. 1 is a horizontal sectional view of an embodiment of the present invention.

FIG. 1 is a horizontal sectional view of a termination coaxial connector according to an embodiment of the present invention. The bottom half of the diagram depicts the internal configuration of the connector when the plug connector is not connected, and the top half of the diagram depicts the internal configuration of the connector when the plug connector is connected. In FIG. 1, the right side is the input terminal, namely the side into which the plug connector is screwed. In the bottom half of the diagram, showing the state in which no plug connector is connected, a contact piece, which is a portion of the center conductor of the receptacle connector of FIG. 1, connects to one end of a resistance element. The other end of the resistance element contacts the outer conductor of the receptacle connector. Matched termination is carried out using a high-frequency resistance equal to the characteristic impedance of the coaxial cable. In the embodiment shown in FIG. 1, the termination element comprises two 150Ω chip resistance elements, provided in the upper and lower portions of the diagram The two resistance elements are connected in parallel, providing resistance of 75Ω.

When the plug connector is connected, as depicted in the top half of FIG. 1, the structure is electrically separated by the interjection of an insulating sliding tube into the portion of the termination element which the center conductor of the receptacle connector is contacting.

In FIG. 1, threads are cut around an outer conductor (shield) 1 of the receptacle connector in order to screw in a plug connector ring. Further provided are an insulating sliding tube 2, a resistance element 3, a spring is 4 and a center conductor (metal tongue) 5 of the receptacle connector.

The insulating sliding tube 2 comprises a sleeve 2-1, the outer diameter of which is roughly equal to the inner diameter of the outer conductor 1, and a sleeve 2-2, the inner diameter of which is greater than the angular bend 5-3 in the center conductor. The two sleeves 2-1 and 2-2 are provided so as to form coaxial doubled insulation, sleeve 2-1 being longer along the axis than sleeve 2-2, and sleeve 2-1 and sleeve 2-2 are joined at one end by a plug guide-in portion 2-3. A through-hole with a cone-shaped opening is provided in the plug guide-in portion 2-3 in order to guide the center conductor of the plug connector into the center portion to a position directly connecting the center conductor of the receptacle connector.

The insulating sliding tube 2 is created by integral molding of resin, or by cutting a rod of insulating material such as Teflon or the like. A coiled spring 4, which is provided along the axis between the sleeve 2-1 and the sleeve 2-2, pushes the plug guide-in portion 2-3 out from the opening of the outer conductor of the receptacle connector by a predetermined distance. The stray reactance of the coiled spring 4 can be reduced by using insulating material, rather than metal, to form the coiled spring 4, thereby improving its connecting characteristics.

Furthermore, a securing member 6 secures the center conductor 5 in the center of the receptacle connector. One end of the center conductor 5 has a receiving portion 5-1 which is in contact with the center conductor of the plug connector. The other end of the center conductor 5 (in other words, the rear end of the receptacle connector) has a terminal 5-2 which connects to an electrical circuit by contact or soldering or the like. In addition, the center portion of the center conductor 5 has an angular bend 5-3 which contacts one end of the resistance element. The pressing force of the coiled spring 4 presses one end of the resistance element 3*a* with the result that the other end of the resistance element 3*a* contacts with the inner surface of the outer conductor 1 of the receptacle connector.

The plug guide-in portion 2-3, which forms a part of the insulating sliding tube 2, is pushed out from the end opening of the outer conductor 1 by a predetermined distance. However, when the plug guide-in portion 2-3 is pushed inside the connector, the sleeve 2-1 and the sleeve 2-2 slide along the axis, and sleeve 2-2 insulates the portion between the center conductor contact and the bump 5-3 which contacts with the end of the resistance element, thereby breaking the termination. At this point, the spring force of the center conductor 5 of the receptacle connector holds the center conductor of the plug connector in place, maintaining a connection between both center conductors. Simultaneously, the insulating sliding tube 2 becomes interjected between the bump 5-3 and the end of the resistance element 3*a*, increasing the strength of the hold on the center conductor of the plug connector.

Figure 2:
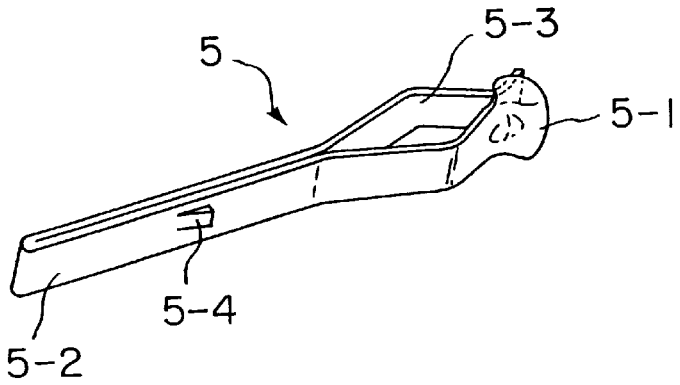
FIG. 2(*a*), FIG. 2(*b*) and FIG. 2(*c*) are views showing the configuration of internal elements of the embodiment of FIG. 1, FIG. 2(*a*) being a perspective view of a center conductor, FIG. 2(*b*) being a perspective view of a securing member attached to the center conductor, and FIG. 2(*c*) being a perspective view of the state when an insulating sliding tube has been additionally attached.
Figure 2:
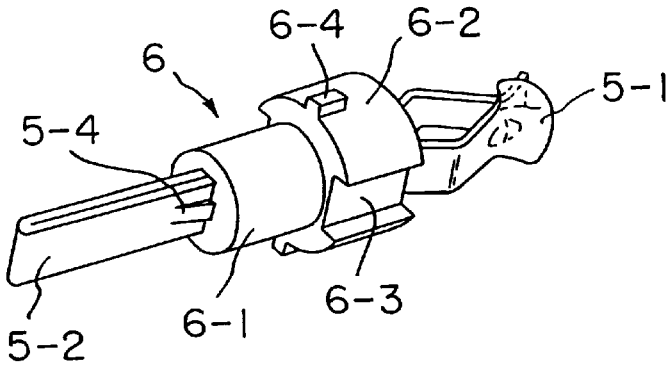
Figure 2:
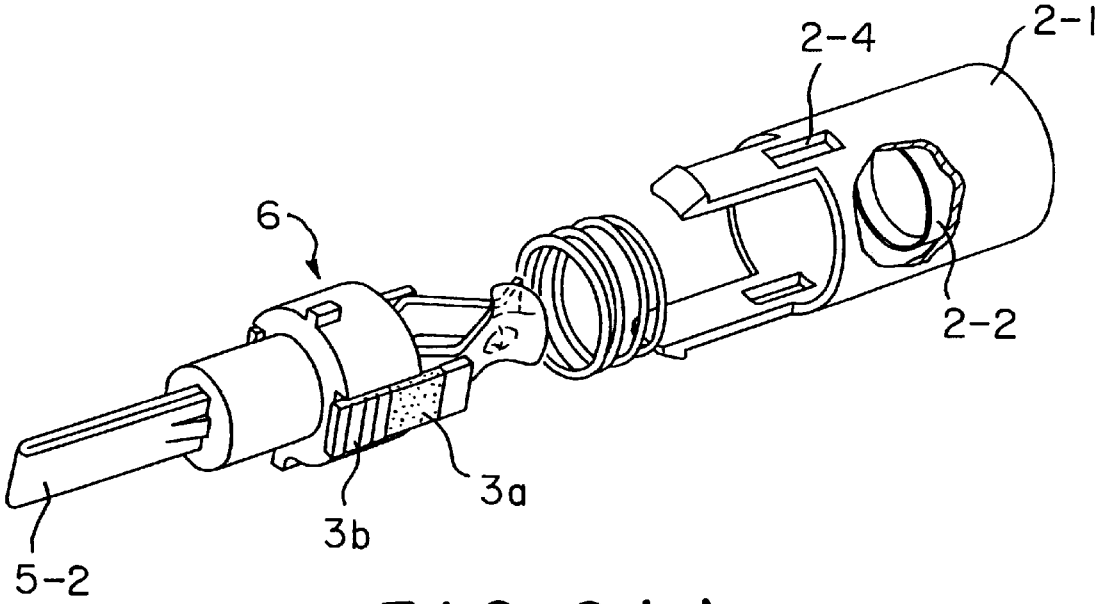
Figure 3:
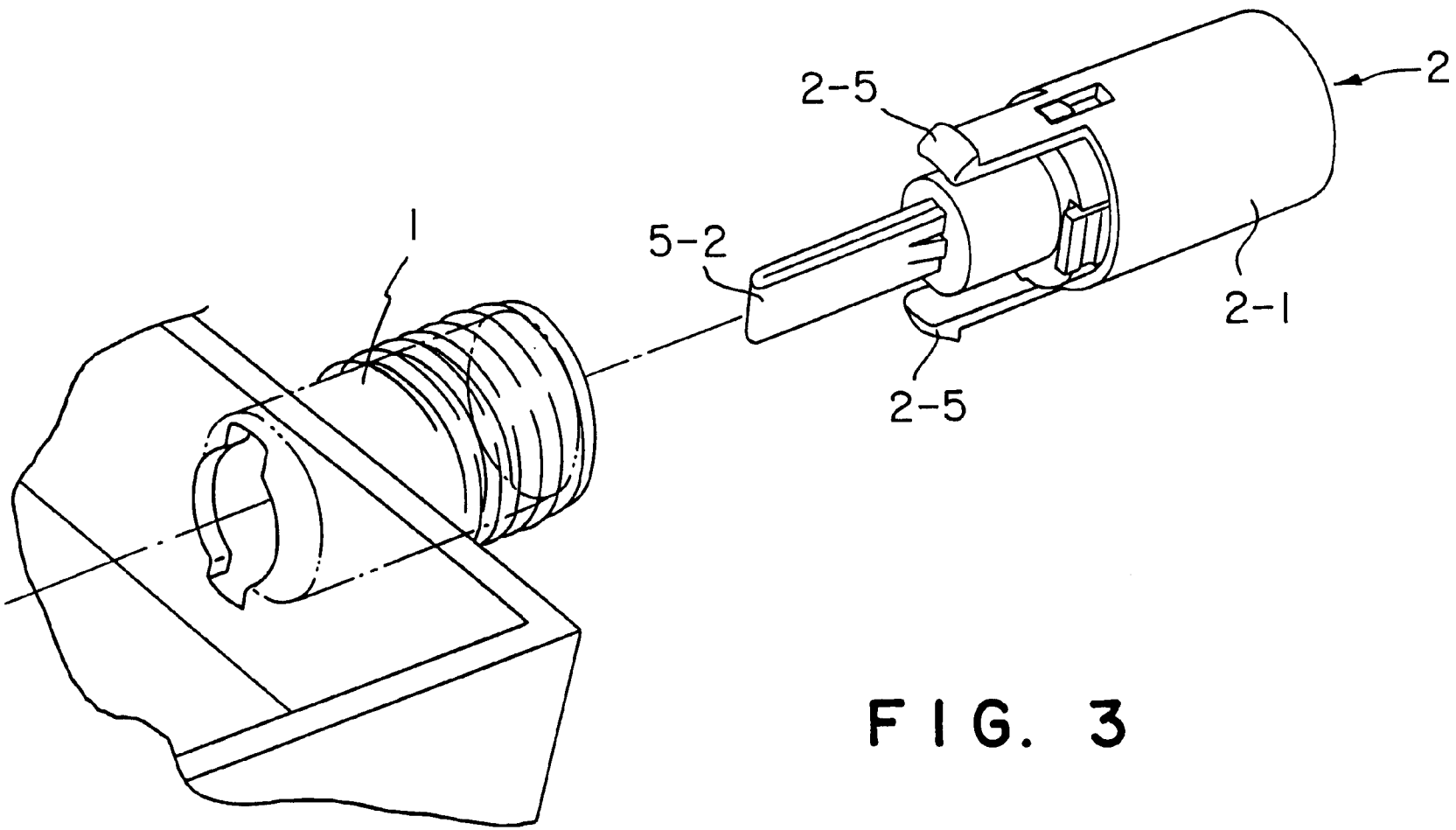
FIG. 3 is a perspective view of the state when internal elements are attached to the outer conductor of the embodiment of FIG. 1.

FIG. 2(*a*), FIG. 2(*b*), FIG. 2(*c*) and FIG. 3 show in detail the relation between the termination element, the metal tongue and the insulating sliding tube of the embodiment of FIG. 1. Firstly, FIG. 2(*a*) shows the inner (center) conductor 5. As FIG. 2(*a*) shows, the center conductor 5 is created by bending one long strip roughly in the middle and folding this to form a double strip. The open end forms the receiving portion 5-1 and the doubled end forms the terminal 5-2. The receiving end 5-1 has a tongue-like shape, which is created by opening the two ends of the long strip, bending both ends sideways toward each other, and forming a roughly circular hole therebetween, so as to provide a guide-in portion for the center conductor of the plug connector. Next, the two folded sides of the strip, from the receiving portion 5-1 to the middle of the center conductor 5, are bent away from each other so as to form angles therein, thereby opening a space, which is approximately diamond-shaped, between the two sides. As FIG. 1 shows, the tips of these angles touch the side of the termination element 3. Moreover, notches 5-4 are provided slightly to the side of the middle of the doubled strip.

As FIG. 2(*b*) shows, when the center conductor 5 is inserted into the securing member 6 from the terminal 5-2 side, the notches 5-4 catch against the end of the securing member 6, thereby stopping the securing member 6 and enabling the securing member 6 to be held more firmly in place around the center conductor 5.

The securing member 6 comprises a small-diameter cylindrical portion 6-1 and a large-diameter roughly cylindrical portion 6-2 which forms a ring around the small-diameter cylindrical portion 6-1. The small-diameter cylindrical portion 6-1 fits into a hole provided in the bottom wall of the outer conductor, and the large-diameter roughly cylindrical portion 6-2 is directly connected to the inner surface of the outer cylindrical portion of the insulating sliding tube 2. A part of the large-diameter roughly cylindrical portion 6-2 is cut out, forming cut-out portions 6-3. In addition, protrusions 6-4 are provided on the perimeter of the roughly cylindrical portion 6-2 at roughly 90 degrees distance from the cut-out portions 6-3.

As FIG. 2(*c*) shows, the termination element 3 is housed in the cut-out portions 6-3, and the protrusions 6-4 fit into the clip holes 2-4 on the insulating sliding tube 2, supporting the insulating sliding tube 2 in such a manner that the insulating sliding tube 2 is able to slide up and down the axis direction within a predetermined range.

FIG. 3 illustrates how the insulating sliding tube 2 is connected to the outer conductor 1 after the insulating sliding tube 2 has been Joined to the securing member 6 according to the process shown in FIG. 2(*c*). By inserting the insulating sliding tube 2 into the cylinder of the outer conductor 1 in such a manner that the terminal 5-2 fits into a partially protruding irregular-shaped circular hole, provided in the outer conductor 1, stoppers 2-5, which are provided on the end of the insulating sliding tube 2 nearest the terminal 5-2, connect to the irregular-shaped portion of the circular hole and secure the insulating sliding tube 2 to the outer conductor 1. As a result, the insulating sliding tube 2 is secured to the outer conductor 1, while being capable of sliding along the direction of its axis within a predetermined distance.

Embodiment 2

Figure 4:
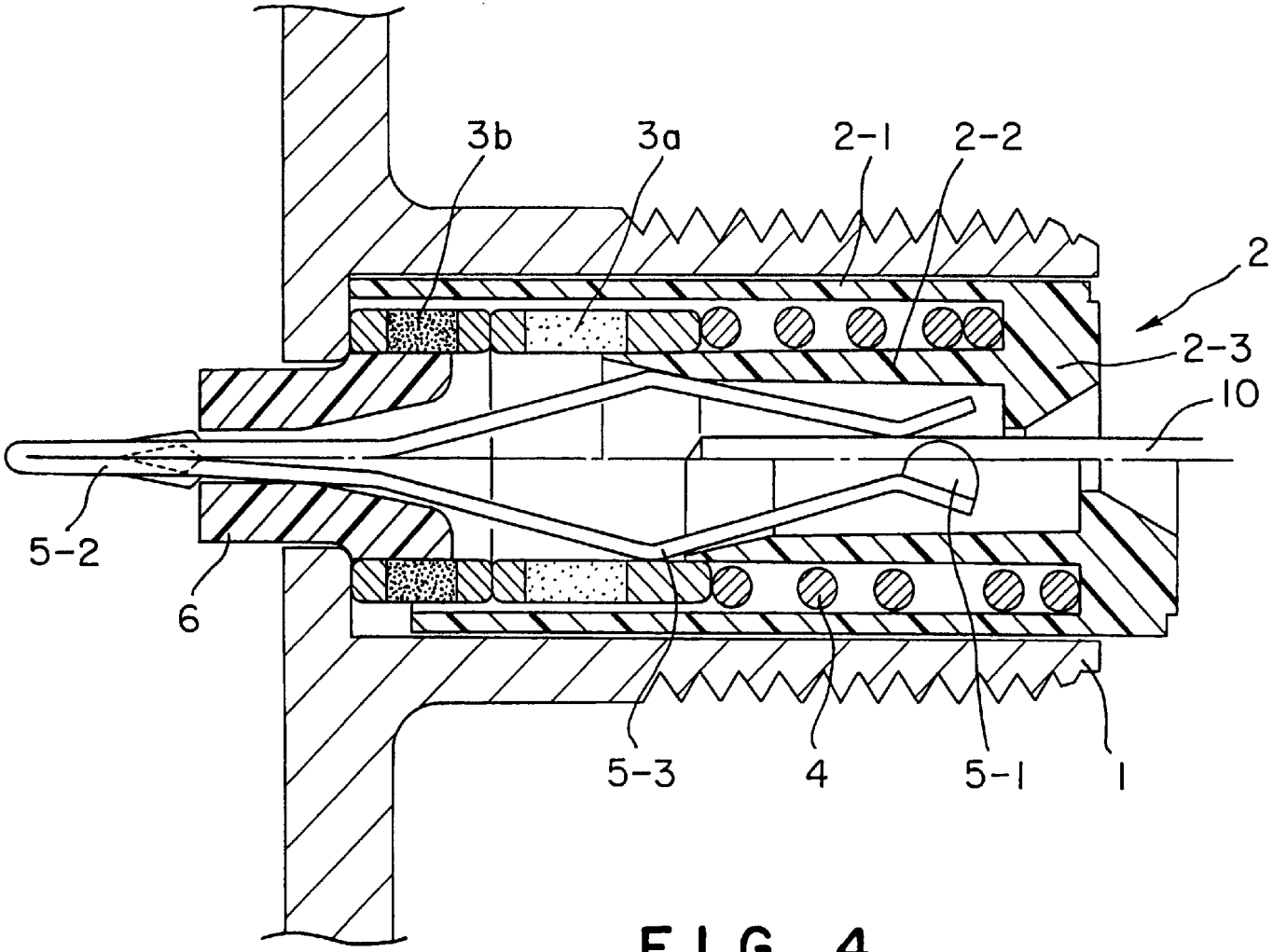
FIG. 4 is a horizontal sectional view of another embodiment of the present invention.

FIG. 4 is a vertical sectional view of another embodiment of the present invention. The input terminal, namely the plug connector, is screwed in on the left side of the diagram. The embodiment depicted in FIG. 4 operates in the same way as the embodiment depicted in FIG. 1 and the same codes are used for the same elements. Furthermore, as in FIG. 1, the bottom half of FIG. 4 shows the internal configuration of the connector when the plug connector is not connected, while the top half of the diagram shows the internal configuration of the connector when the plug connector is connected. The resistance element 3*a* and capacitance element 3*b* are connected in series, as in the embodiment in FIG. 7 to be described later. However, the embodiment in FIG. 4 differs from the embodiment in FIG. 1 in respect of the fact that, in FIG. 4, the resistance element 3*a* and the capacitance element 3*b* are both cylindrical.

Figure 5:
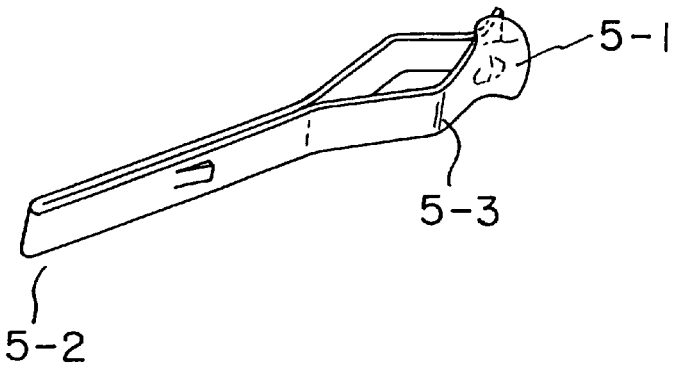
FIG. 5(*a*), FIG. 5(*b*) and FIG. 5(*c*) are views showing the configuration of internal elements of the embodiment of FIG. 4, FIG. 5(*a*) being a perspective view of a center conductor, FIGS. 5(*b*) being a perspective view of a securing member attached to the center conductor, and FIG. 5(*c*) being a perspective view of the state when an insulating sliding tube has been additionally attached.
Figure 5:
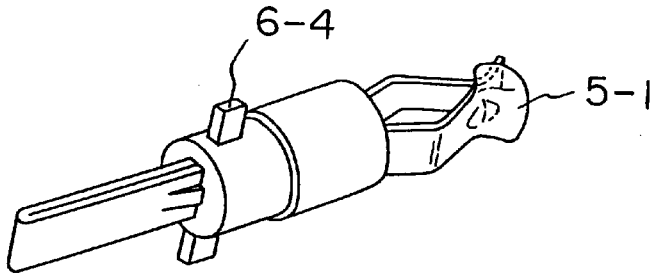
Figure 5:
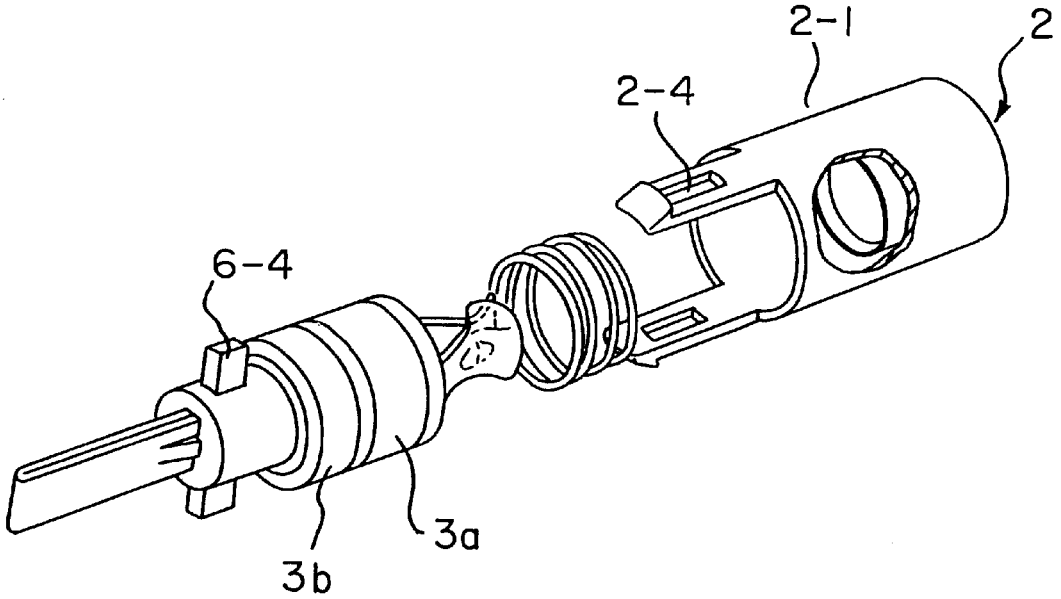
Figure 6:
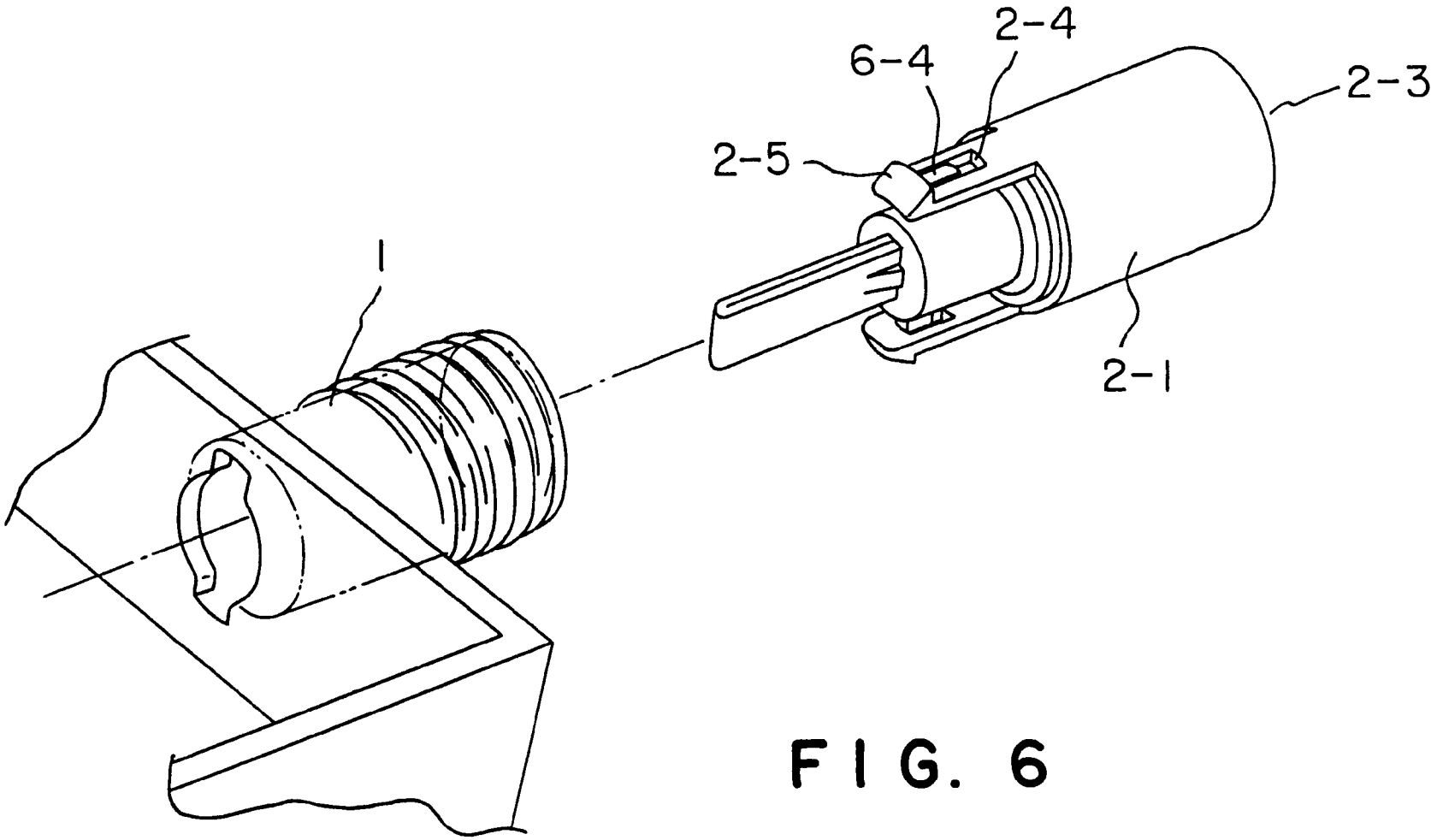
FIG. 6 is a perspective view of the state when internal elements are attached to the outer conductor of the embodiment of FIG. 4.

FIG. 5(*a*), FIG. 5(*b*), FIG. 5(*c*) and FIG. 6 are views showing in detail the configuration of the internal elements of the embodiment of FIG. 4, the elements being arranged in the same states as those shown in FIGS. 2(*a*), (*b*), (*c*) and FIG. 3 respectively. In FIGS. 5(*a*), (*b*) and (*c*), the cylindrical substrate of the resistance element forming the termination element 3 comprises an aluminum cylinder. The surface of the aluminum cylinder comprises a resistant substance, formed by evaporating tantalum nitride. In addition, terminals comprising resistance elements 3*a*, formed by evaporating silver, are provided at each end. Furthermore, in FIG. 5, the cylindrical substrate of the capacitance element 3*b* is formed form a material having high permittivity, such as barium titanate, and further comprises a coating of silver, formed by evaporation, on the surface of the cylinder and inside the cylinder. In addition, terminals comprising capacitance elements 3*b*, similarly formed by evaporating silver, are provided at each end.

The purpose of using these cylindrical parts is that, when the resistance elements are concentrated in one place, as in the embodiment in FIG. 1, the resultant stray reactance damages the resistance characteristics at high-frequencies. However, by using cylindrical components which have distributed constants, it is possible to carry out termination while continuing to transmit quasi-transverse electromagnetic waves. Furthermore, FIG. 6 shows the state of the components depicted in FIG. 5 immediately prior to assembling the outer conductor 1.

Embodiment 3

Figure 7:
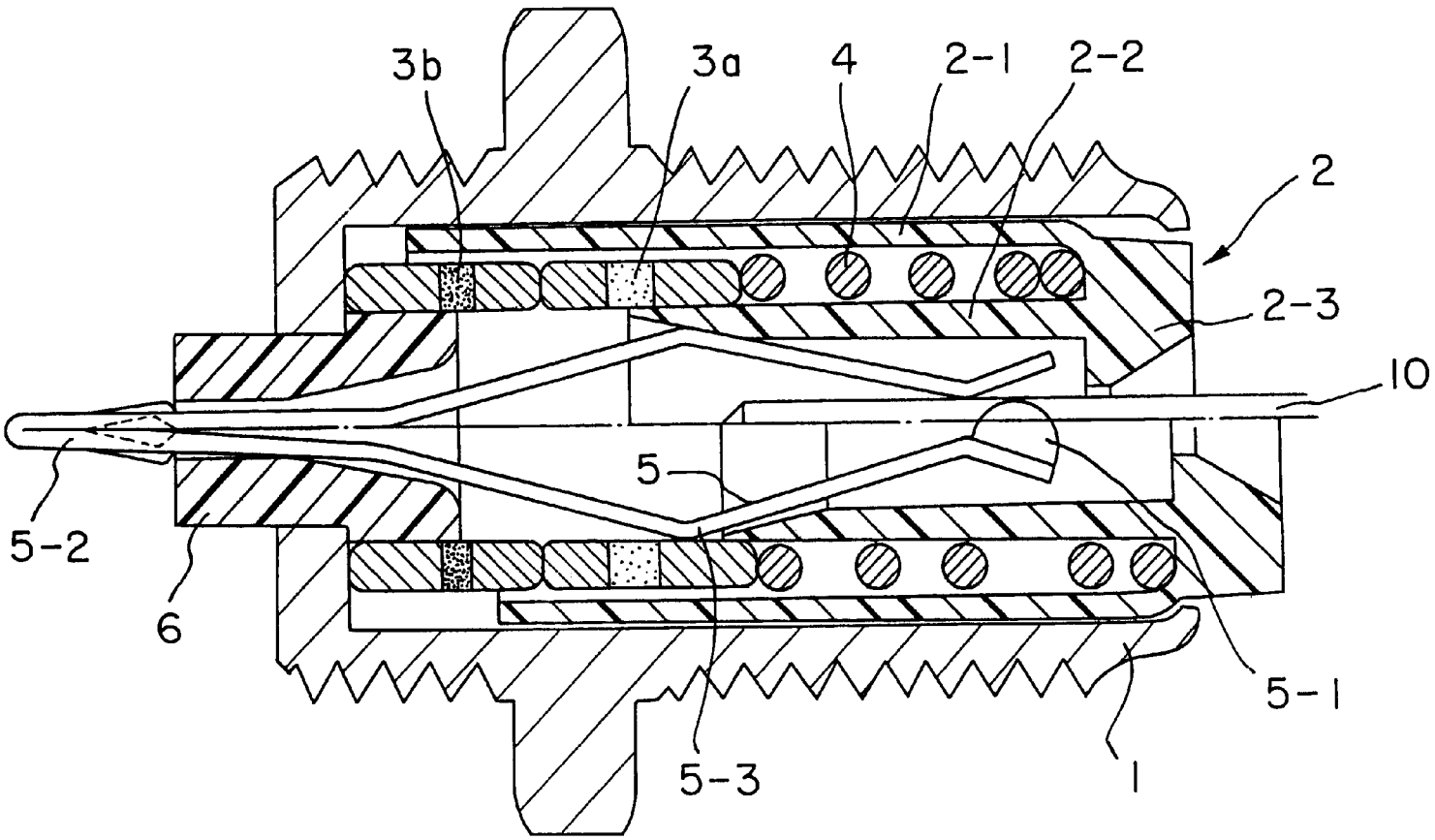
FIG. 7 is a horizontal sectional view of yet another embodiment of the present invention.

FIG. 7 is a horizontal sectional view of yet another embodiment of the present invention. The input terminal, namely the plug connector, is screwed in on the right side of the diagram. The left side of the diagram shows a screw structure which is provided in the outer conductor 1 in order to screw the connector into an enclosure. Furthermore, as in FIG. 1, the bottom half of FIG. 7 shows the internal configuration of the connector when the plug connector is not connected, while the top half of the diagram shows the internal configuration of the connector when the plug connector is connected. The embodiment in FIG. 7 differs from the embodiment in FIG. 1 in respect of the fact that, in FIG. 7, the resistance element 3*a* and the capacitance element 3*b* are connected in series.

The purpose of connecting the resistance element 3*a* and the capacitance element 3*b* in series is to prevent burning when low-frequency power from the plug connector side, for instance, power to be supplied to a BS converter or a booster amp, is multiplexed on the coaxial cable. In other words, in the embodiment shown in FIG. 1, at the moment that the center conductor of the plug connector touches the center conductor of the receptacle connector, power current flows to the resistance element 3*a* causing the resistance element 3 to burn. This burning is prevented by the provision of the capacitance element 3*b*.

Figure 8:
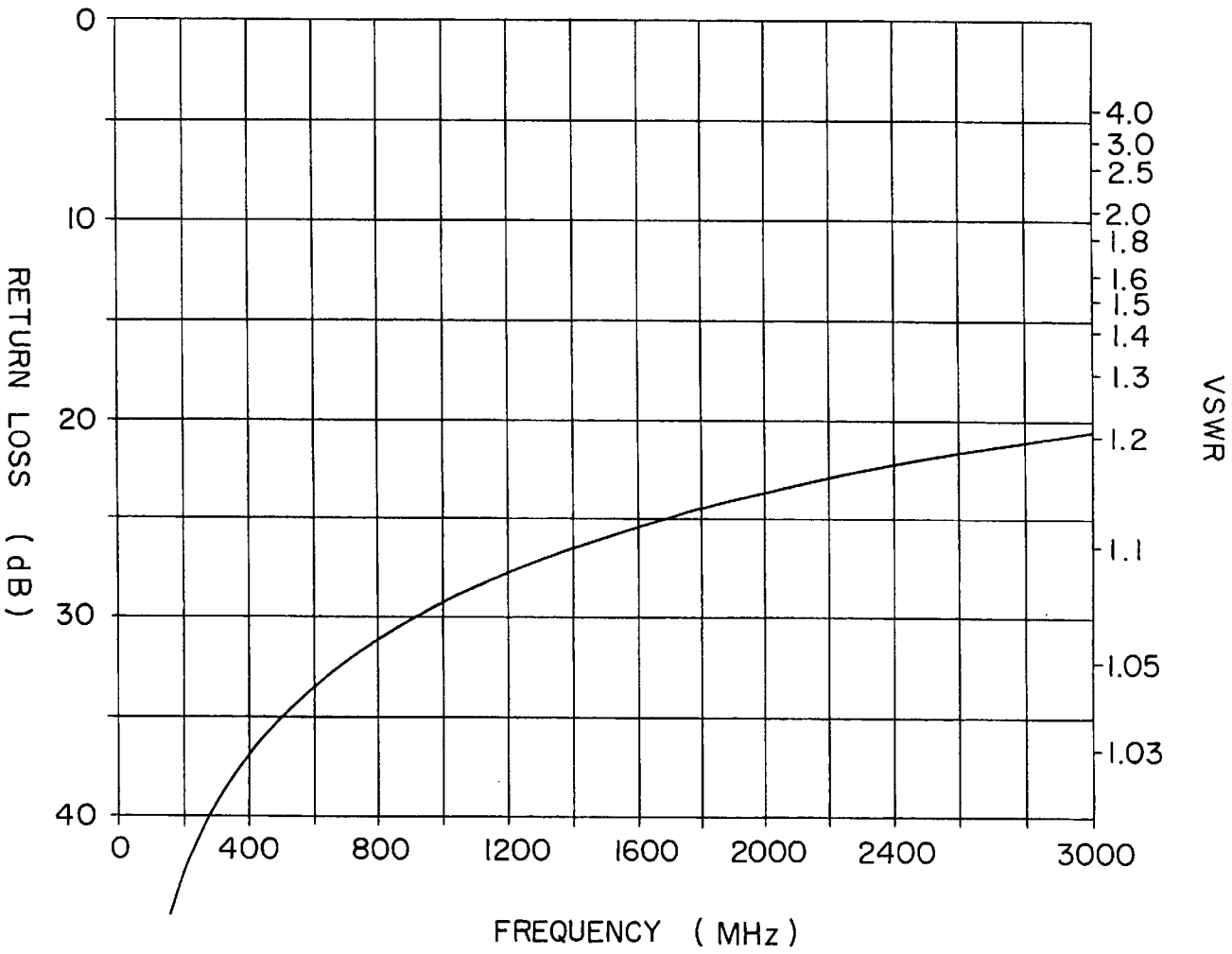
FIG. 8 is a view of termination characteristics of each of the embodiments of the present invention.
Figure 9:
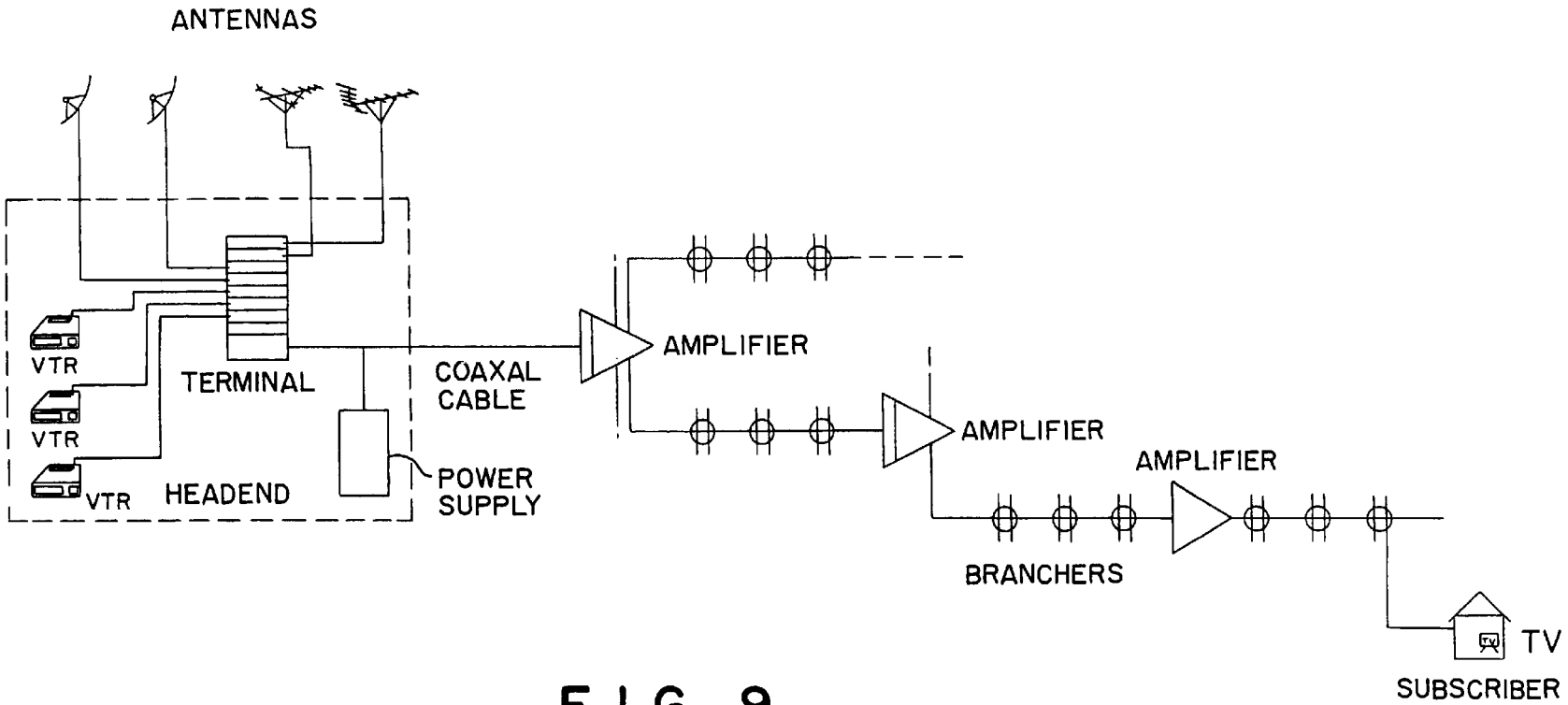
FIG. 9 is a view of a conventional joint TV viewing system using splitters and branchers.
Figure 10:
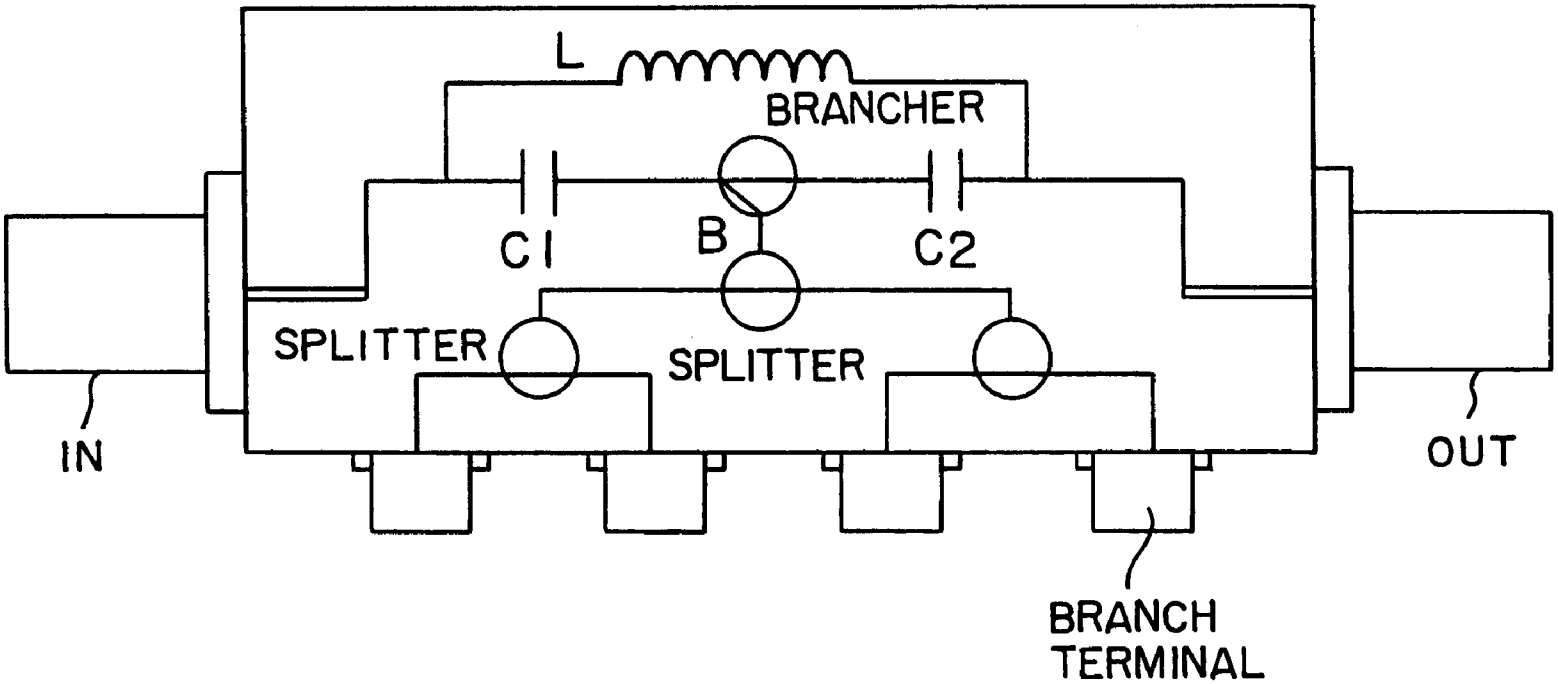
FIG. 10 is a circuit configuration diagram showing a splitter used in a conventional joint TV viewing system.
Figure 11:
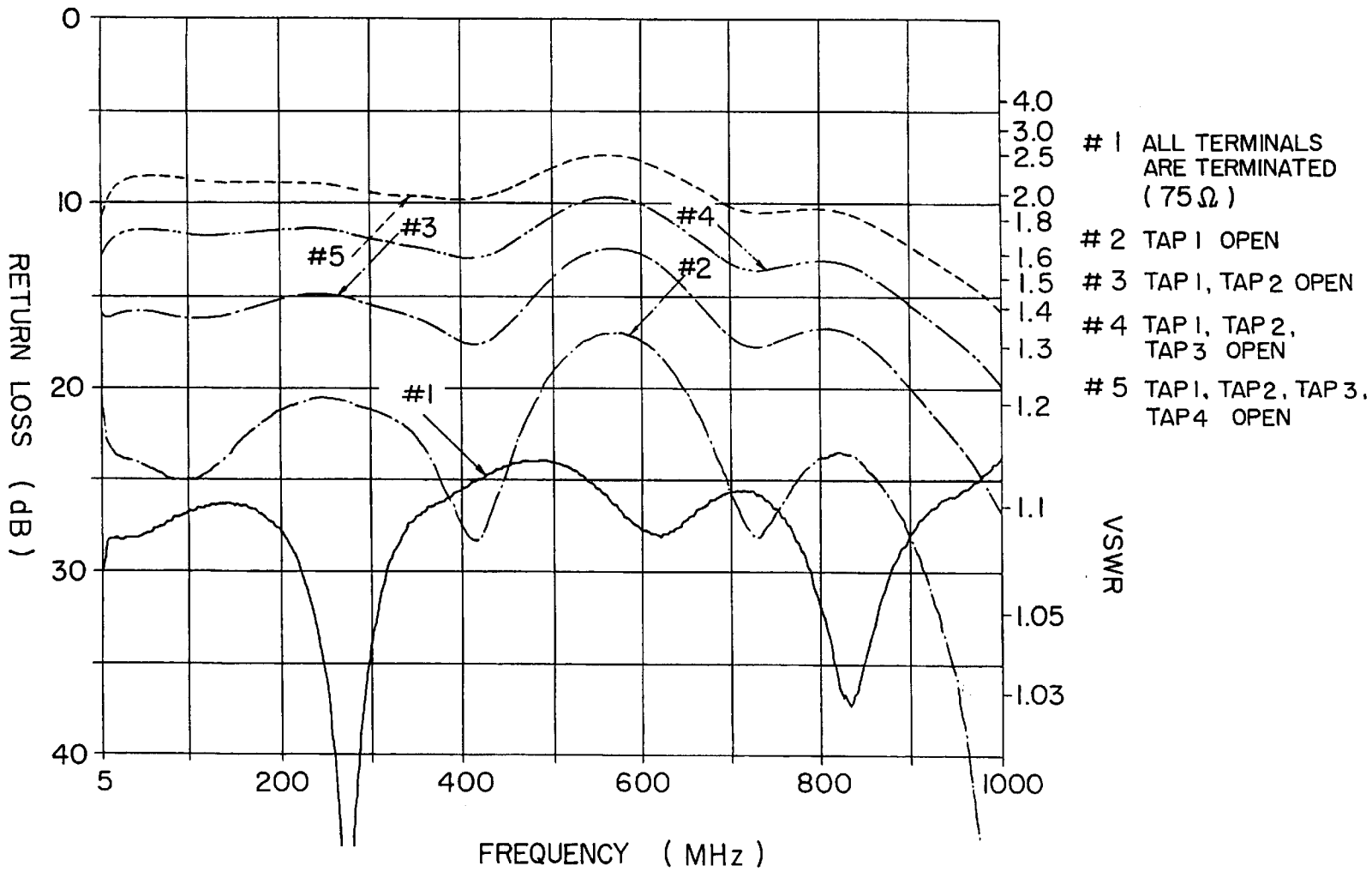
FIG. 11 is a diagram showing the change in characteristics between a splitter used in a conventional joint TV viewing system and a case when vacant terminals are present.
Figure 12:
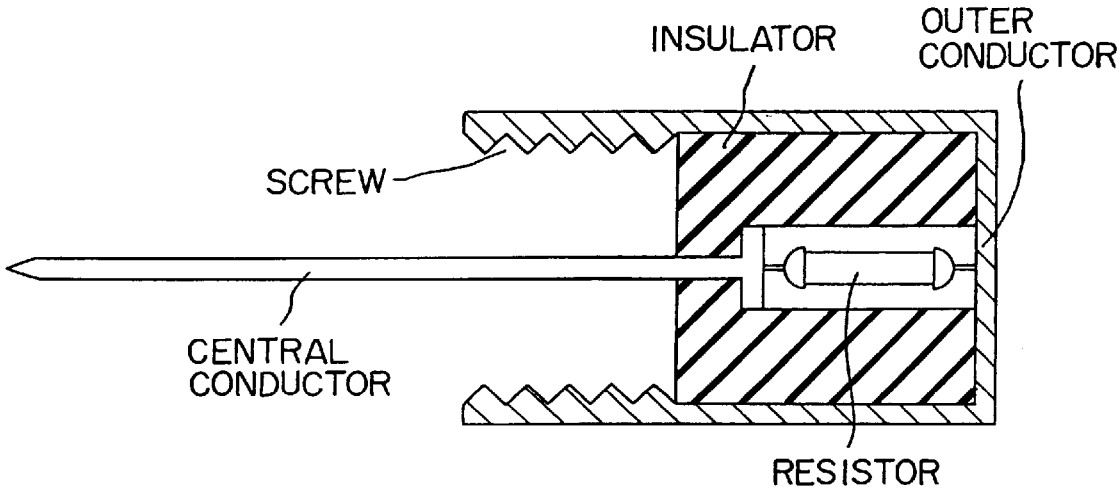
FIG. 12 is a diagram illustrating the structure of a terminator for a vacant terminal used in a conventional joint TV viewing system.
Figure 13:
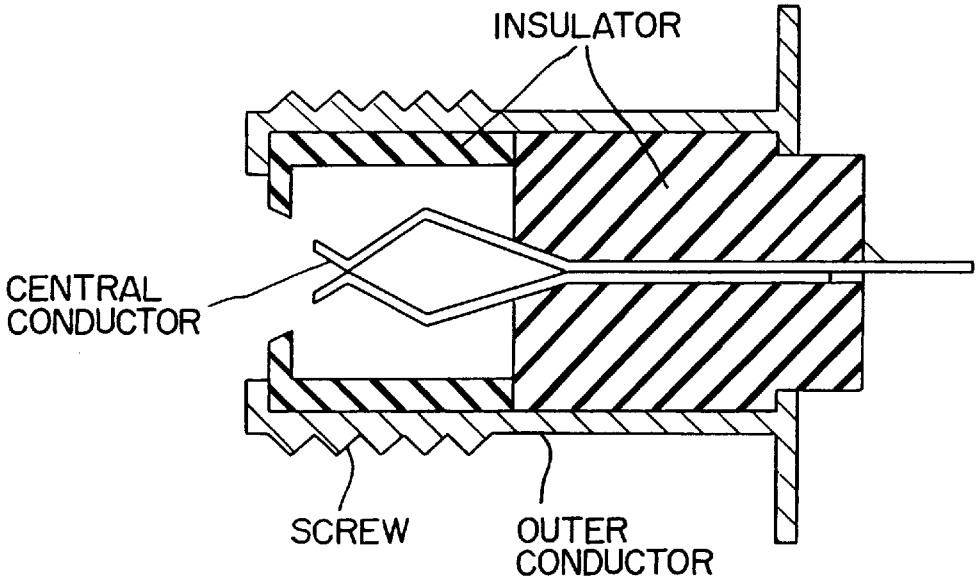
FIG. 13 is a diagram illustrating the structure of an F-type connector (receptacle connector) used in a conventional joint TV viewing system.

FIG. 8 is a view of the termination characteristics of each of the embodiments of the present invention. As FIG. 8 shows, when TEM waves enter from the right side of FIG. 4, namely the connector input side, toward the front end, each of the embodiments described above has reflection loss of 20 dB, within a range of DC–3 GHz. Therefore, the present invention can be used not only for signals transmitted from the termination coaxial connector side, but also when power has been multiplexed thereupon.

The embodiments described above referred to a joint TV viewing system, but the device of the present invention can also carry out terminations within the connector, with no effect on internal components, and can be used as a connector for apparatuses other than cable television apparatuses.

As explained above, the present invention can be economically used as a connector not only in joint TV viewing apparatuses, but also in a variety of wide frequency band signal circuits which use coaxial cables to transmit digital signals, such as local area networks (LAN).

Furthermore, the device of the present invention has the secondary advantageous effect of enabling the core wire of the coaxial cable, namely the center conductor, to be firmly held in place.

While there have been described what are at present considered to be preferred embodiments of the invention, it will be understood that various modifications may be made thereto, and it is intended that the appended claims cover all such modifications as fall within the true spirit and scope of the invention.

What is claimed is:

1. A termination coaxial F-type receptacle connector for connecting to a coaxial F-type connector, comprising:

an outer conductor, having an opening provided at one end thereof and a through-hole provided at the middle of another end thereof, said outer conductor having a screw-threaded outer perimeter and a vacant cylindrical inner portion;

an insulating sliding tube, said insulating sliding tube comprising insulating material and comprising a coaxial double-insulation cylinder comprising an outer cylindrical portion and an inner cylindrical portion, said inner cylindrical portion being shorter along the axis direction than said outer cylindrical portion, said inner and outer cylindrical portions being joined at one end and a ring-shaped space being provided therebetween, said insulating sliding tube having a plug guide-in portion, provided at the middle of said end, and an end portion at an end of said inner cylindrical portion which is opposite to said joined end, said end portion being housed within said space of said outer conductor so as to slide along said outer cylindrical portion, said end portion being wedge-shaped in cross-section and becoming thinner towards the tip of said end portion;

a securing member for supporting said insulating sliding tube so that said insulating sliding tube is able to slide within a predetermined range, and also for holding a termination element, said securing member being joined to the bottom wall of said outer conductor;

an inner conductor for contacting a center conductor of a plug connector, said inner conductor being supported within said insulating sliding tube; and said termination element being provided so as to be pressed toward a bottom wall of said outer conductor by the expansive force of a coil spring, said coil spring being housed in said ring-shaped space in said insulating sliding tube, said termination element being ordinarily connected between said outer conductor and said inner conductor;

wherein, when said insulating sliding tube is pushed toward the bottom wall of said outer conductor as a result of the insertion of a plug connector, said end portion of inner cylindrical portion, being wedge-shaped in cross-section, is forced between said inner conductor and said termination element, thereby separating them.

2. A termination receptacle connector, for terminating a coaxial line by connecting a resistance element between an outer conductor and an inner conductor of a coaxial line connector, comprising:

a sleeve-shaped insulating sliding tube 2 comprising insulating material and having a plug guide-in portion inside said receptacle connector, said insulating sliding tube comprising a first sleeve having an outer diameter which is roughly equal to the inner diameter of said outer conductor, and a second sleeve having an inner diameter which is greater than the outer diameter of said inner conductor;

said first sleeve and said second sleeve having a plug guide-in portion on an end surface of a portion where said first sleeve and said second sleeve Join together, said plug guide-in portion being projected out of an end surface of said outer conductor by the force of a spring provided between said first sleeve and said second sleeve, said resistance element being inserted between said first sleeve and said second sleeve so that one end thereof contacts an outer conductor of said receptacle connector and another end thereof contacts a center conductor of said receptacle connector, thereby carrying out termination;

wherein, when a plug connector has been inserted into said receptacle connector, an end surface of the plug connector pushes said plug guide-in portion along the axis direction and said insulating sliding tube slides toward the end surface of said outer conductor, causing a portion of said insulating sliding tube to be interjected between said resistance element and said inner conductor, thereby breaking the electrical connection between said outer conductor and said inner conductor.

3. A termination coaxial connector according to claim 2, further comprising;

a capacitance element, said capacitance element being connected in series with said resistance element.

4. A termination coaxial connector according to claim 2, wherein said resistor comprises a cylindrical film resistor.

5. A termination coaxial connector according to claim 3, wherein said capacitance element is cylindrical.

6. A termination receptacle connector wherein a resistance element is connected between an outer conductor and an inner conductor of a coaxial line connector, comprising:

a sleeve-shaped insulating sliding tube 2 comprising insulating material and having a plug guide-in portion inside said receptacle connector, said insulating sliding tube comprising a first sleeve having an outer diameter which is roughly equal to the inner diameter of said outer conductor, and a second sleeve having an inner diameter which is greater than the outer diameter of said inner conductor;

said first sleeve and said second sleeve having a plug guide-in portion on an end surface thereof, and said plug guide-in portion being projected outside said outer conductor due to the force of a spring provided between said first sleeve and said second sleeve;

wherein said inner conductor is connected to said resistance element, said inner conductor of said connector comprises a pair of metallic tongue-shaped pieces, bent at angles to provide a spring force, said resistance element is secured to the inner surface of said outer conductor by the spring force, in which position one end of said resistance element contacts an bump portion of the angle in said inner conductor, an end of said resistance element touches an inner surface of said outer conductor, and the spring secures said resistance element to said insulating sliding tube, with the result that, when a plug connector is inserted into said receptacle connector, said insulating sliding tube slides toward the end surface of said outer conductor, causing a portion of said insulating sliding tube to be interjected between said resistance element and said inner conductor, thereby breaking the electrical connection between said outer conductor and said inner conductor.

7. A termination coaxial connector according to claim 6, further comprising:

a capacitance element, said capacitance element being connected in series with said resistance element.

8. A termination coaxial connector according to claim 6, wherein said resistor comprises a cylindrical film resistor.

9. A termination coaxial connector according to claim 7, wherein said capacitance element is cylindrical.

* * * * *